United States Patent [19]

Lever

[11] 4,331,250

[45] May 25, 1982

[54] CAM ACTION CORK

[76] Inventor: Richard N. Lever, 401 NE. Second, Enterprise, Oreg. 97828

[21] Appl. No.: 132,396

[22] Filed: Mar. 20, 1980

[51] Int. Cl.[3] ..... B65D 39/08

[52] U.S. Cl. ..... 215/356

[58] Field of Search ..... 215/356, 357, 355, 296; 220/289, 373, 374, 304

[56] References Cited

U.S. PATENT DOCUMENTS

| | | | |
|---|---|---|---|
| 694,013 | 2/1902 | Hayes | 215/356 |
| 1,423,592 | 7/1922 | Baldwin | 215/355 X |
| 4,098,422 | 7/1978 | Slomski | 215/355 |

FOREIGN PATENT DOCUMENTS

| | | | |
|---|---|---|---|
| 1129726 | 9/1956 | France | 215/355 |

*Primary Examiner*—Donald F. Norton

*Attorney, Agent, or Firm*—Klarquist, Sparkman, Campbell, Leigh, Whinston & Dellett

[57] ABSTRACT

A cork for detachably sealing sparkling wines, champagnes and the like having, in a first embodiment, concentric sealing rings and helically arranged threads for thrusting the cork upward in response to counter-clockwise rotation, and, in a second embodiment, stops and helically arranged threads.

3 Claims, 3 Drawing Figures

CAM ACTION CORK

BACKGROUND OF THE INVENTION

The present invention relates generally to corks for bottles and more particularly to sealing corks for sparkling wines, champagnes and the like.

In the bottling of sparkling wines and champagnes, stoppers or "corks" of plastic have been presented having an enlarged portion, an elongate tubular shank and concentrically arranged ridges. Th ridges having a larger cross section than that of the neck of "wine bottles" and ths shank having an increasing cross section in a direction toward the head portion for the purpose of sealing gases within the bottle and for preventing the pressures of said gases from dislodging the cork.

Such devices function well for the intended purpose but necessitate very strong hands and fingers to extract these corks. However, many persons lack adequate strength to achieve the extraction. It is therefore believed to be desirable to improve such corks so that any person, irrespective of strength, can easily remove same.

SUMMARY OF THE INVENTION

The present invention is provided with an enlarged head portion having an outwardly radially extending base of predetermined cross section which tapers gently to a truncated disc upper portion and raised gripping surfaces radially distributed about said upper portion. Attached to the head portion and projecting therefrom opposite the upper portion is an elongate tubular shank.

In a first embodiment, the shank is provided with a group of concentrically arranged and outwardly radially extending ridges adapted to maintain the cork inside a bottle neck when placed therein and to maintain gases within the bottle. The shank further having a group of helically arranged and outwardly extending threads adapted to thrust the cork upwardly in response to counter clockwise motion applied to the head portion of the cork.

In a second embodiment, the concentric ridges are eliminated and replaced by outwardly radially extending stops mounted proximate alternate ones of the helical threads.

It is therefore a primary objective of the present invention to provide a cork which is readily removable from a bottle irrespective of the physical strength of the particular user.

Yet further objectives, features and advantages will become apparent and the invention will be more readily understood from the drawings and the detailed description and claims which follow.

DETAILED DESCRIPTION OF THE INVENTION

Figure 1:
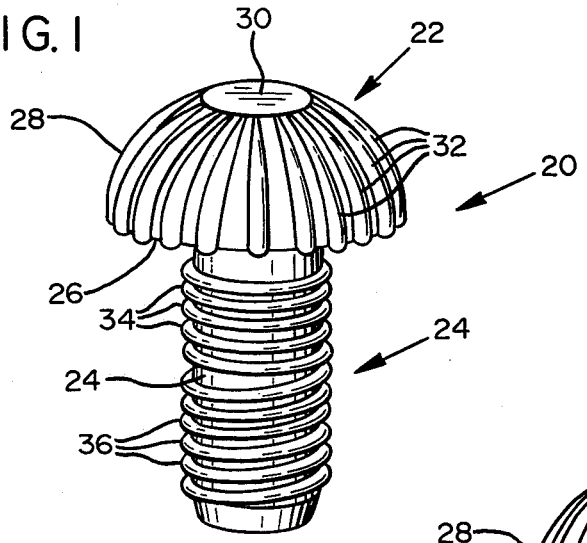
FIG. 1 is a perspective view depicting a preferred embodiment for the head portion of the present cork.

Referring now to the drawings, numeral 20 refers generally to a cork, preferably of resilient polymeric material, which is useful for sealing bottles of sparkling wine, champagnes and the like.

Cork 20 is provided with an enlarged head portion 22 and an elongate tubular shank 24.

Head portion 22 is provided with a base 26 of predetermined cross section which is mounted on shank 24 and extends radially outwardly therefrom and with a top 28 which tapers gently upward to a truncated disc 30 of predetermined cross section less than that of the base. Disposed radially in spaced apart relation about top 28 is a plurality of raised gripping surfaces 32.

Figure 2:
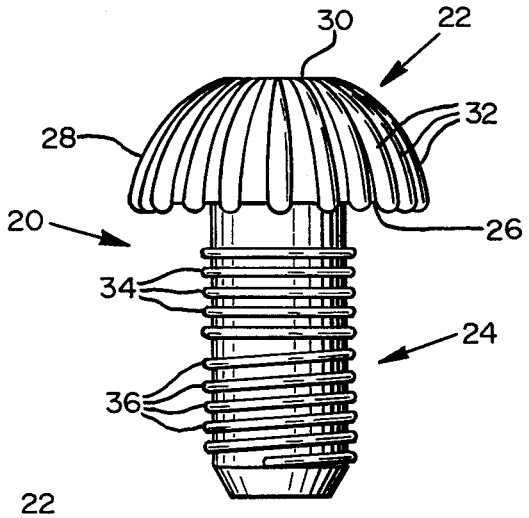
FIG. 2 is a perspective view depicting a first embodiment for the shank portion of the present cork.

Shank 24 is provided with a first exemplary embodiment, shown in FIG. 2, with a group of concentrically arranged and outwardly extending ridge 34, each having predetermined resiliency and cross section suitable for releasably maintaining the cork inside the neck of a wine bottle and for releasably maintaining gases within such bottle.

Shank 24 is further provided in the embodiment of FIG. 2 with a group of helically arranged and outwardly extending threads 36 each having predetermined resiliency and cross section suitable for bearing upon the interior surface of the bottle neck and thrusting cork 20 out of the neck in response to a counter clockwise force applied against gripping surfaces 32, thereby producing a cam-like action.

Figure 3:
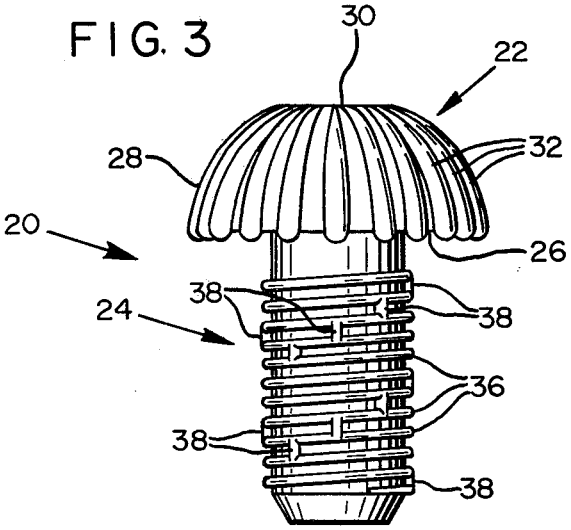
FIG. 3 is a perspective view depicting an alternate embodiment for the shank of FIG. 2.

In an alternative embodiment shown in FIG. 3, ridges 34 are eliminated and stops 38 are mounted intermediate selected ones of threads 36 at intervals for preventing gas escapement in a spiral flow following the threads.

The terms used in the preceding abstract and descriptions are used as terms of illustration and not of limitation and there is no intention in the use of such terms and expressions of excluding equivalents of the features shown and described, it being understood that the claimed invention is limited solely by the claims that follow.

What is claimed is

1. In combination with a wine bottle having an interior surface in its neck, a sealing cork for maintaining gases and liquids within said bottle, comprising:

(a) an enlarged head portion having base means for limiting the degree of insertion of said cork into said bottle and raised gripping surface means distributed radially about said head portion in spaced apart relation for applying rotary force to said cork;

(b) an elongate shank having a predetermined cross section less than that of said head portion, mounted upon said head portion and projecting at a right angle from said head portion;

(c) cam means for bearing upon the interior surface within the neck of said bottle and thrusting said cork from said bottle in response to a counter clockwise force applied to said gripping surface means, including a group of resilient helically arranged threads mounted on said shank and each of said threads projecting radially outwardly therefrom to compressingly engage said interior surface; and (d) sealing means integrally disposed along a portion of said shank adjacent said threads and projecting radially outwardly therefrom for compressingly engaging the interior surface of the bottle neck at a position spaced below the entrance thereof to prevent the egress of gases from said bottle through said cam means.

2. The combination of claim 1 in which the sealing means includes a series of concentric annular flanges positioned above the group of helically arranged threads.

3. The combination of claim 1 in which the sealing means includes a series of stops comprising ridges integrally formed on the surface of said shank and extending between said threads.

* * * * *